US010759075B2

(12) United States Patent
Baker

(10) Patent No.: US 10,759,075 B2
(45) Date of Patent: Sep. 1, 2020

(54) BLADE SHARPENING SYSTEM FOR A LOG SAW MACHINE

(71) Applicant: Lawrence E Baker, Clarkston, WA (US)

(72) Inventor: Lawrence E Baker, Clarkston, WA (US)

( * ) Notice: Subject to any disclaimer, the term of this patent is extended or adjusted under 35 U.S.C. 154(b) by 0 days.

(21) Appl. No.: 15/138,211

(22) Filed: Apr. 25, 2016

(65) Prior Publication Data

US 2016/0236369 A1 Aug. 18, 2016

Related U.S. Application Data

(62) Division of application No. 14/274,561, filed on May 9, 2014, now Pat. No. 9,321,184.

(60) Provisional application No. 61/821,628, filed on May 9, 2013.

(51) Int. Cl.

| | |
|---|---|
| ***B24B 3/36*** | (2006.01) |
| ***B24B 3/46*** | (2006.01) |
| ***B26D 7/12*** | (2006.01) |
| ***B24D 7/14*** | (2006.01) |
| ***B24D 13/14*** | (2006.01) |
| ***B26D 1/14*** | (2006.01) |
| ***B26D 3/16*** | (2006.01) |
| ***B24B 49/16*** | (2006.01) |

(52) U.S. Cl.

CPC ..... *B26D 7/12* (2013.01); *B24B 3/363* (2013.01); *B24B 3/368* (2013.01); *B24B 3/46* (2013.01); *B24B 49/16* (2013.01); *B24D 7/14* (2013.01); *B24D 13/14* (2013.01); *B24D 13/147* (2013.01); *B26D 1/14* (2013.01); *B26D 3/16* (2013.01); *Y10T 83/303* (2015.04)

(58) Field of Classification Search

CPC .. B24B 3/36; B24B 3/363; B24B 3/46; B24D 7/02; B24D 7/04; B24D 7/063; B24D 7/14; B24D 13/14; B24D 13/147; B26D 7/12

USPC ..... 451/45, 261, 262, 269, 293

See application file for complete search history.

(56) References Cited

U.S. PATENT DOCUMENTS 1,551,167 A * 8/1925 Orlow ..... B24B 3/56 451/152

2,309,016 A * 1/1943 Ryan ..... B24D 7/14 451/548

(Continued)

*Primary Examiner* — Eileen P Morgan

(74) *Attorney, Agent, or Firm* — Mark Farrell

(57) ABSTRACT

A blade sharpening system for log saw machines is provided. An example multiphase grinding wheel has a grinding face with one or more abrasive concentric rings for sharpening the cutting blade of the log saw machine, and one or more padded concentric rings consisting of fiber padding. Sharpening with the multiphase grinding wheel improves cut quality, increases blade life, removes glues and varnishes from the cutting blade, reduces blade deformation, and hones the edge of the cutting blade. A pneumatic tensioning system uses air bladders to apply a dynamically cushioned pressure between the grinding wheels and the cutting blade. The fiber-padded grinding wheels and the air bladder tensioner provide improved sharpness of the cutting blade and longer life for the mechanical components. The padded grinding wheels decrease fire risk, and the tensioner can be operated remotely, decreasing human injuries common with conventional setup actions near the sharp cutting blade.

14 Claims, 14 Drawing Sheets

(56) References Cited

U.S. PATENT DOCUMENTS 2,451,295 A * 10/1948 Metzger ..... B24D 7/14 451/461
2,867,063 A * 1/1959 Metzger ..... B24D 7/06 451/548
4,173,846 A * 11/1979 Steiner ..... B23D 63/14 451/422
5,090,281 A * 2/1992 Paulson ..... B24B 3/368 83/13
5,496,209 A * 3/1996 Gaebe ..... B24B 3/36 451/548
5,503,592 A * 4/1996 Neumann ..... B24B 9/16 451/278
5,626,065 A * 5/1997 Cattini ..... B26D 7/12 451/295
6,062,958 A * 5/2000 Wright ..... B24B 37/11 451/288
6,312,325 B1 * 11/2001 Van Osenbruggen ... B24D 7/10 451/449
6,419,574 B1 * 7/2002 Takahashi ..... B24B 53/017 451/443
6,749,496 B2 * 6/2004 Mota ..... B24D 5/16 451/342
7,004,823 B2 * 2/2006 Kisboll ..... B24B 37/26 451/461
7,527,546 B2 * 5/2009 Nishihara ..... B24B 37/16 451/36
8,801,497 B2 * 8/2014 Schwappach ..... B24D 11/00 451/28
2003/0162488 A1 * 8/2003 Bancon ..... B24D 5/12 451/527
2004/0235406 A1 * 11/2004 Duescher ..... B24D 11/001 451/527
2006/0211353 A1 * 9/2006 Kodani ..... B24D 7/06 451/548
2012/0184186 A1 * 7/2012 Graham, Jr. ..... B23D 63/123 451/45
2013/0324014 A1 * 12/2013 Dovel ..... B24B 3/36 451/45
2014/0154961 A1 * 6/2014 Fiore ..... B24D 5/14 451/527

* cited by examiner

BLADE SHARPENING SYSTEM FOR A LOG SAW MACHINE

RELATED APPLICATIONS

This divisional patent application claims the benefit of priority to U.S. patent application Ser. No. 14/274,561 to Baker, filed May 9, 2014, which in turn claims the benefit of priority to U.S. Provisional Patent Application No. 61/821,628 to Baker, filed May 9, 2013, entitled, "Blade Sharpening System for Log Saw Machine," both incorporated herein by reference in their entireties.

BACKGROUND

Log saw machines can be used to cut long rolls of paper products, such as paper towels and toilet paper into shorter rolls for marketing to consumers. As shown in FIG. 1, a conventional log saw machine consists of an orbital blade 100 capable of rotating through a log of paper ("paper log" or "log") to cut the log into consumer-size products, with two smaller grinding wheels 102 & 104 on either side of the orbital blade 100, which can contact an edge of the orbital blade 100 to automatically sharpen the orbital blade 100. The grinding wheels 102 & 104 sharpen the orbital blade 100 simultaneously, as the orbital blade 100 cuts the paper log. The grinding wheels 102 & 104 or "grinders" may be controlled by computer or by a programmable logic controller (PLC). A standard timing scenario for grinding is, for example, at every twenty cuts of the orbital blade, the grinding wheels 102 & 104 grind the edge of the orbital cutting blade 100 for four seconds. The cutting speed of the orbital blade 100 can be approximately 250 cuts per minute.

Conventional grinding wheels 102 & 104 used on tissue log saw machines employed a vitrified surface that causes the problems of sparking, loose grit, and a constant need for cleaning and adjustment. As the industry changes and the papers being cut become softer and lighter, the rolls of paper become more difficult to cut, and fires also become a problem.

Grinding wheels with cubic boron nitride (CBN) were introduced, generally in six inch or four inch diameters with a one-quarter inch face. The CBN grinding wheels sharpen better with less nicking and chipping than those with previously used abrasives. But due to conventional types of grinding systems, it is very difficult to design a bond between the grinding wheel and the CBN surface that breaks down properly under operational circumstances.

Besides the problem of designing a wheel that breaks down properly, there are three types of glue involved in the operation that affect the grinding wheels: transfer glue, the tail tie, and core glue. These glues load up on the face of the blade causing poor cut quality. Attempts to improve conventional grinding wheels have met little success. For example, using multiple types of CBN generally fails, as the various glues load up both types of CBN used. Lubricants were also introduced to help fight the glue problems, but provided little improvement. Costs to shut down and clean is a large cost to the industry in both production and safety. For example, the average cost of a production line can be around $1500.00 USD per hour. Moreover, there have been numerous accidents at all mills while operators cleaned the sharp blades and grinding wheels.

Conventionally, operators need to manually set the grinding wheels 102 & 104 to the orbital blade 100 for sharpening. This procedure is conventionally performed every 4-5 hours of production. Conventional metal pneumatic cylinders may be used to bring the grinding wheels 102 & 104 into the close vicinity of an orbital blade 100 for a sharpening cycle, and then used to remove or "pull back" the grinding wheels 102 & 104 after sharpening.

Air pressure is not conventionally used to tension the grinding wheels 102 & 104 against the orbital blade 100 during the sharpening itself. Conventionally, mechanical sharpening pressure, or tension, must be custom-set by hand and by human judgment. As shown in FIG. 2, the conventional tensioning is relatively fixed and rigid, and since the grinding rings 106 of conventional grinding wheels 102 & 104 are relatively narrow, the pressures between the grinding wheels 102 & 104 and the orbital blade 100 result in distortion, deformation, or deflection off a narrow point of the orbital blade 100 during sharpening (shown as exaggerated in FIG. 2).

Conventionally, if the stones, i.e., the grinding wheels 102 & 104 are not setup correctly then the orbital blade 100 becomes damaged and must be changed prematurely. Moreover, the setup of the grinding wheels 102 & 104 and adjustment is not a reliably safe procedure for human operators, as the exquisitely sharp orbital blade 100 and other potentially hazardous hardware are nearby at all times during the adjustment processes.

DETAILED DESCRIPTION

Overview

This disclosure describes a blade sharpening system for log saw machines. The example blade sharpening system has multiple advantageous components and features. Example grinding wheels and an example tensioning system are described below.

Example Grinding Wheels

Figure 1:
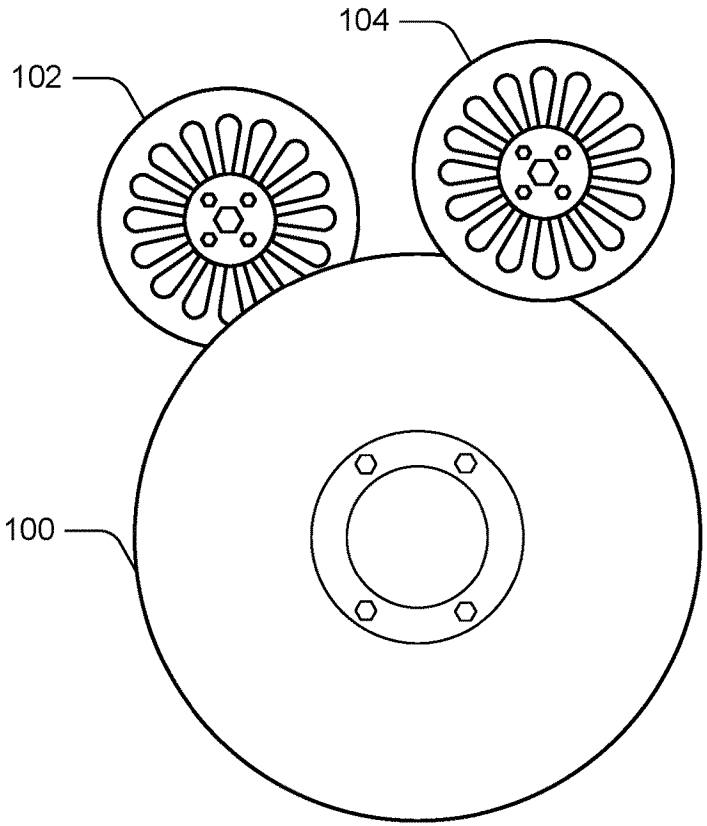
FIG. 1 (PRIOR ART)
FIG. 1 is a diagram of a conventional orbital cutting blade of a saw machine for cutting logs of rolled paper, with two grinding wheels positioned on either side of the orbital cutting blade.
Figure 2:
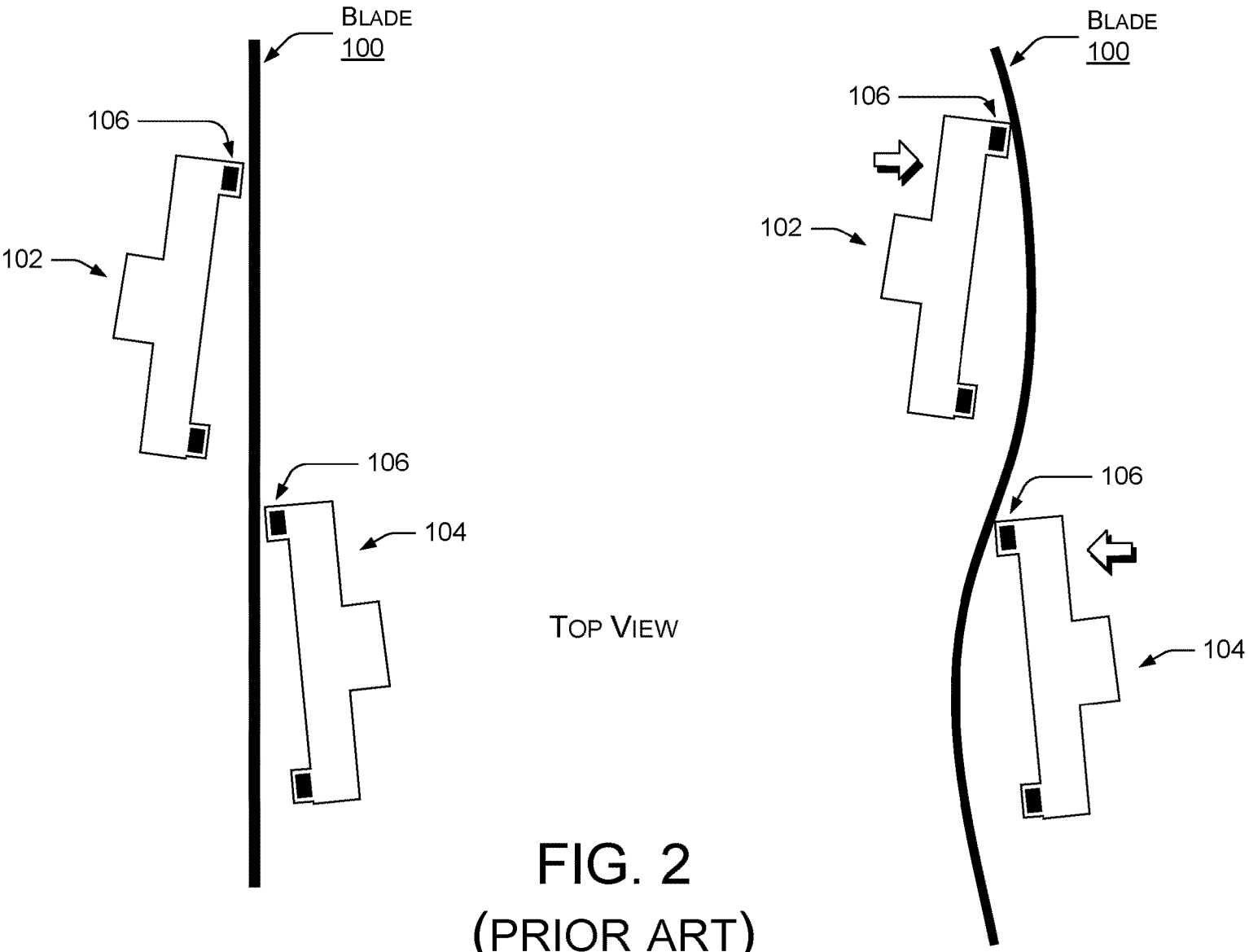
FIG. 2 (PRIOR ART)
FIG. 2 is a diagram of conventional blade distortion, deformation, and deflection using conventional grinding wheels for sharpening.
Figure 3:
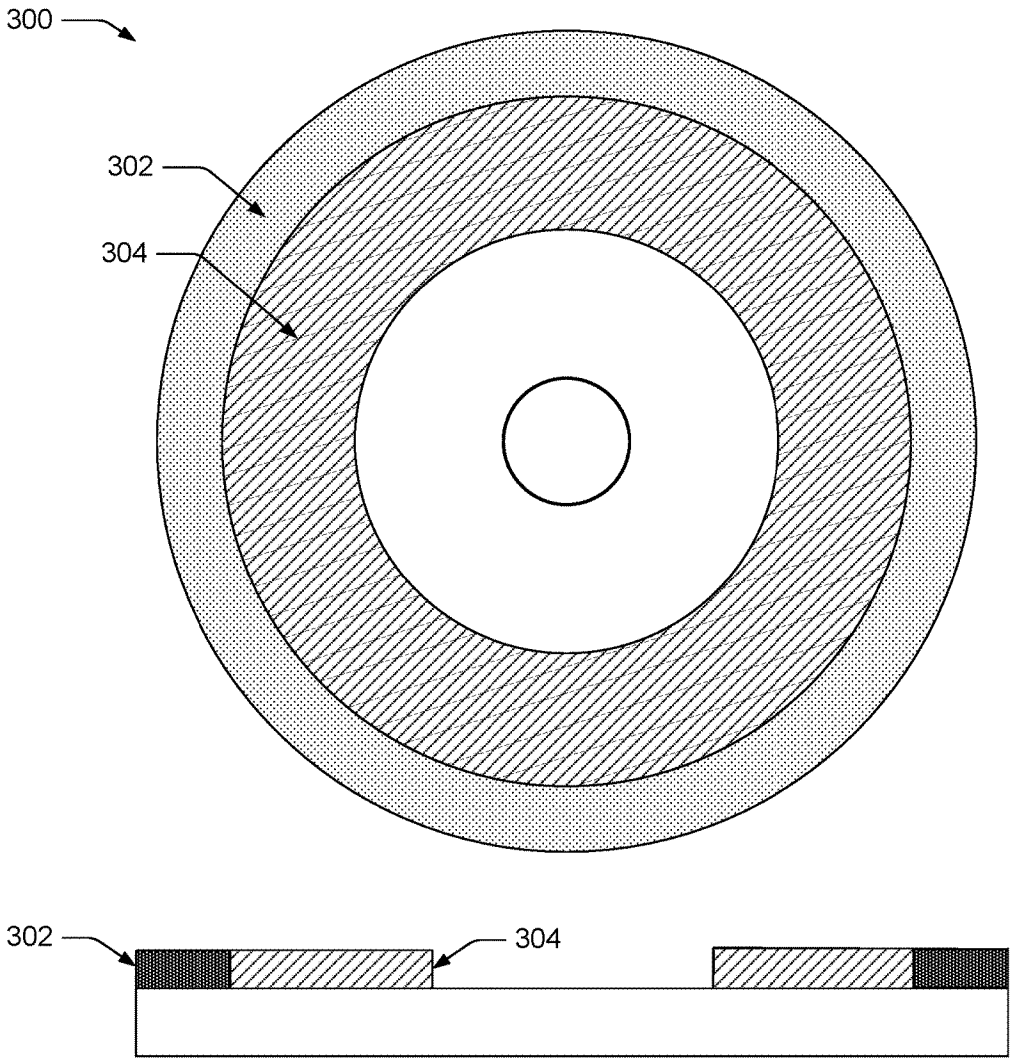
FIG. 3 is a diagram of an example multiphase grinding wheel having a concentric contact ring of abrasive grit and a concentric contact ring of fiber padding.

FIG. 3 shows an example multiphase grinding wheel 300. In an implementation, the multiphase grinding wheel 300 consists of a backing plate or pad, instead of the conventional rigid wheel in which only an outer race conventionally contacts the orbital blade 100 to be sharpened. The backing plate may be flexible, which provides some advantages, or may be rigid in other implementations.

In an implementation, the example multiphase grinding wheels 300 described herein each include a grinding face that has two or more concentric contact rings. For example, a first concentric contact ring 302 has a relatively hard grinding abrasive, such as particles or grit of cubic boron nitride (CBN), wurtzite boron nitride, silicon carbide, ceramic, or diamond (CBN will be used herein as an example to represent all hard abrasives), and is combined on the grinding face of the multiphase grinding wheel 300 with a second concentric contact ring 304 of a fiber pad. Such a two-phase contact surface can provide numerous advantages, such as:

- improved cut quality,
- a blade life increase of 25-100%,
- less sparking that reduces risk of fire,
- simplified setup of the grinding wheel to the orbital blade,
- a stabilized and cushioned interface between the face of the grinding wheel and the orbital blade,
- removal of glues and varnishes from the orbital blade,
- tempered aggressiveness of the more abrasive (e.g., CBN) concentric ring against the orbital blade,
- reduced distortion of the blade that eliminates blade squaring and scalloping, and
- polishing and honing of the edge of the orbital blade, with no burrs, into extreme sharpness.

The second concentric contact ring 304 made of a fiber pad or padding can be constructed of a solid-woven or nonwoven abrasive pad (e.g., as available from Norton or 3M) bonded to a flexible or non-flexible backing pad. The term "fiber abrasive pad" will be used representatively herein to designate the class of possible nonwoven and solid-woven fiber pads that can be used, including those with various degrees of abrasiveness ranging from almost zero to slightly aggressive. The second concentric contact ring 304 has less abrasive quality than the first concentric contact ring 302 that grinds the cutting edge during sharpening. However, the fiber abrasive pad of the second concentric contact ring 304 hones and polishes the sharp cutting edge created by the more aggressive first concentric contact ring 302. The fiber abrasive pad may have its own abrasive agents, such as a sparse fine powder of CBN impregnated in the fibers, or nano-, microscopic, or fine particles of another abrasive grit, but these are not as aggressively abrasive as those of the first concentric contact ring 302.

Figure 4:
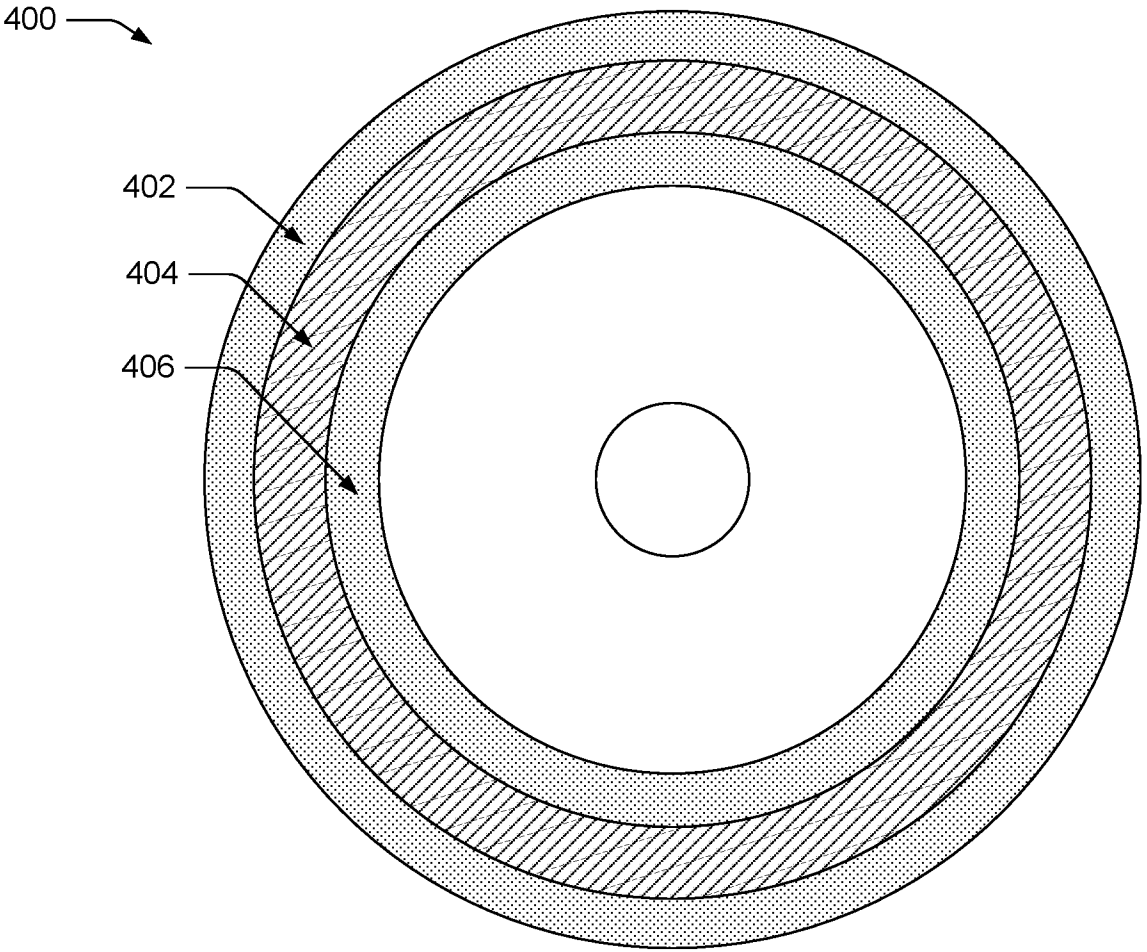
FIG. 4 is a diagram of an example multiphase grinding wheel that has more than two operative concentric contact rings, such as one or more concentric contact rings of abrasive grit and one or more concentric contact rings of fiber padding.

FIG. 4 shows another example multiphase grinding wheel 400 that has multiple concentric contact rings 402 & 404 & 406. A given multiphase grinding wheel, such as grinding wheel 400, may have one of more concentric rings of abrasive for grinding, and one or more concentric rings with nonwoven fiber pad. For example, a given grinding wheel 400 may have a first ring 402 and a third ring 406 that have a CBN abrasive, and a second ring 404 that is nonwoven fiber pad. Or, the example grinding wheel 400 may have a first ring 402 and a third ring 406 that are nonwoven fiber pad, while the second ring 404 has the CBN abrasive for grinding. Combinations of concentric rings that have abrasive for grinding or nonwoven fiber pad may be used.

Figure 5:
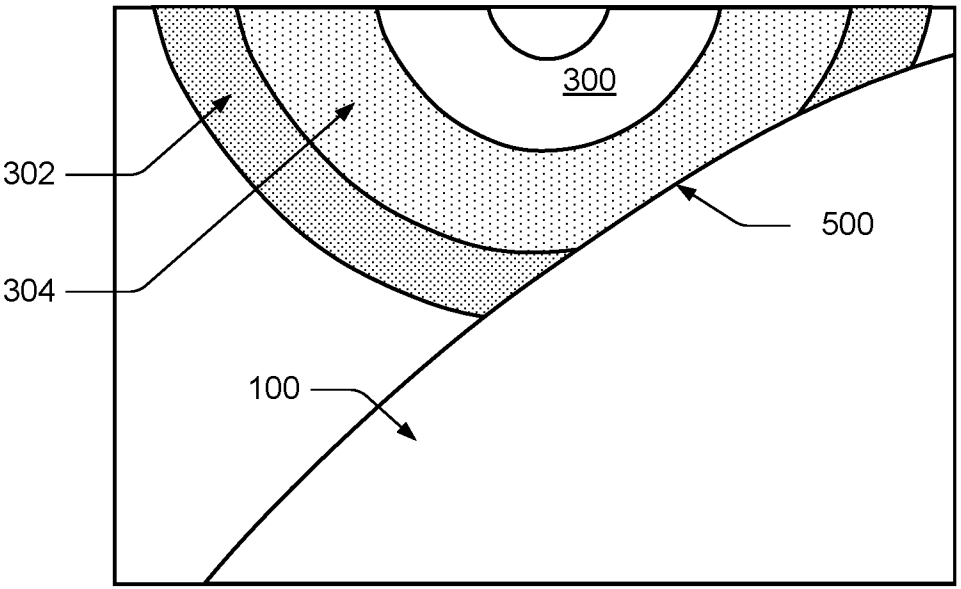
FIG. 5 is a diagram of an example multiphase grinding wheel in contact with the orbital cutting blade of a log saw machine.

FIG. 5 shows an example multiphase grinding wheel 300 in contact with the orbital blade 100 of the log saw machine for sharpening. The nonwoven fiber pad of the second concentric ring 304 on the grinding face provides a dynamic cushion between the grinding wheel 300 and the log saw blade 100 at the same time as the first concentric ring 302 grinds the cutting edge of the blade 100 to sharpness.

The second concentric ring 304 consisting of the nonwoven fiber pad is wide enough to spread the contact pressure between the grinding wheel 300 and the log saw blade 100 over a larger surface area than the contact surface area of the first concentric ring 302 would have if alone, and thereby reduces distortion and deformation of the blade 100 caused by the contact pressure. This improvement over conventional blade deformation also reduces squaring and scalloping of the blade 100.

The nonwoven fiber pad of the second concentric ring 304 can hone and polish the cutting edge of the log saw blade 100 as the same edge is being sharpened by the first concentric ring 302 of the grinding face that has the more aggressive abrasive for sharpening.

The nonwoven fiber pad of the second concentric ring 304 can also reduce sparking caused by the grinding and sharpening and reduces the risk of fire. In addition, the nonwoven fiber pad can buffer the tensioning adjustment between the grinding wheel 300 and the log saw blade 100 since the nonwoven fiber pad makes the contact surface broader and also changes the feel when the grinding wheel 300 and the blade 100 make contact. This slight difference in the contact between grinding wheel 300 and blade 100 can simplify setup of the grinding wheels 300 against the log saw blade 100.

The nonwoven fiber pad can also remove glues and varnishes picked up by the log saw blade 100 from the paper rolls being cut, even while the first concentric ring 302 of the grinding face is maintaining the bevel angle of the cutting edge of the log saw blade 100.

In an implementation, the backing plate of the grinding wheel 300 may also be made flexible to increase the flexibility of the pressure contact between the grinding wheel 300 and the log saw blade 100.

Figure 6:
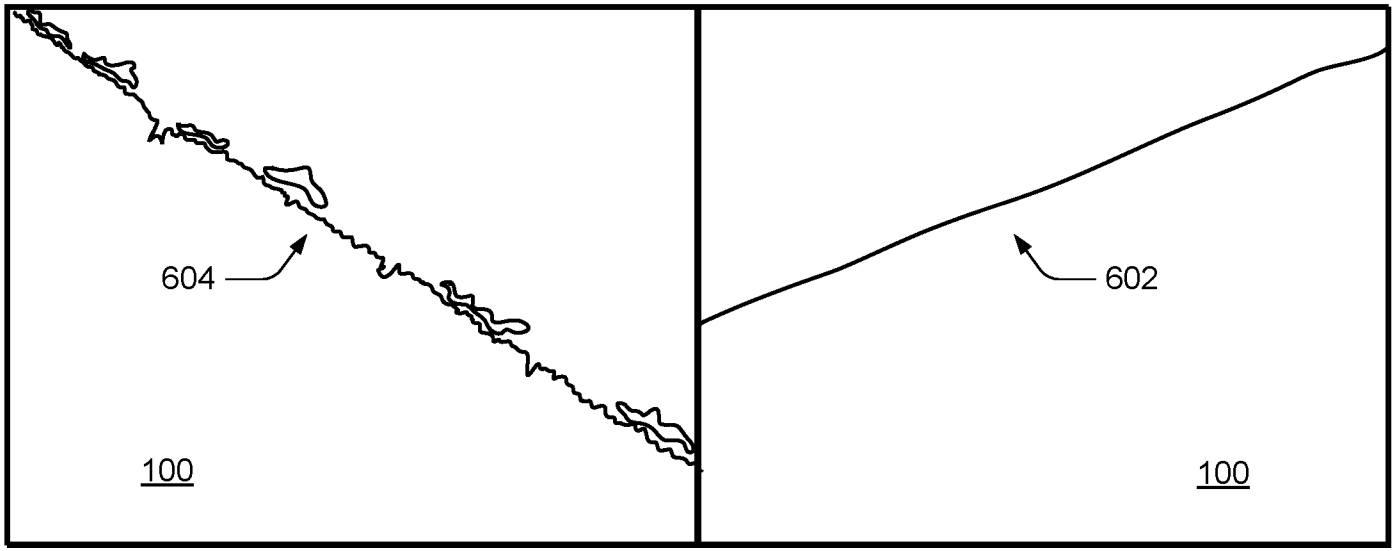
FIG. 6 is a diagram of a conventional sharpened edge of a log saw blade versus a sharpened edge of a log saw blade sharpened by an example multiphase grinding wheel.

In an implementation, the second concentric ring 304 of the grinding face and its fiber pad reduces and tempers the aggressiveness of the first concentric ring 302 in sharpening the cutting edge of the log saw blade 100. As shown in FIG. 6, the dynamically flexible pressure of the grinding wheel 300 on the log saw blade 100 combined with the honing and polishing action of the nonwoven fiber pad produces a sharper, cleaner edge 602 than a conventional sharpened edge 604, which has rough dips and burrs.

Figure 7:
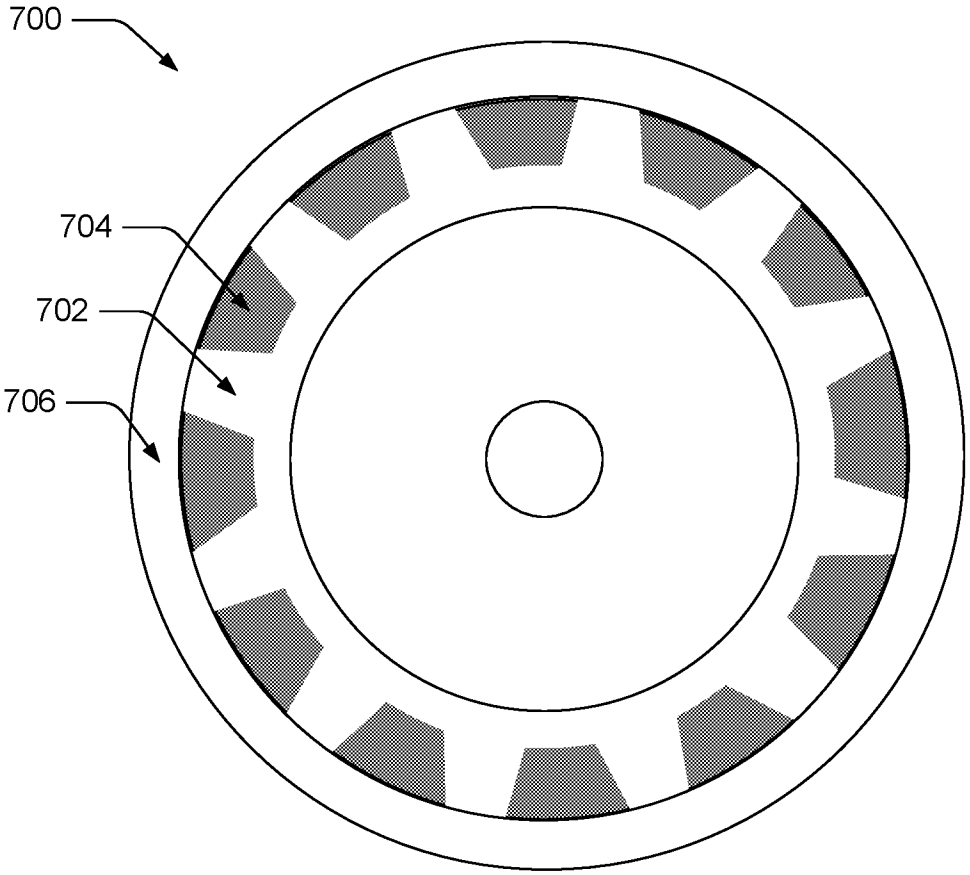
FIG. 7 is a diagram of an example segmented multiphase grinding wheel.

FIG. 7 shows an example segmented multiphase grinding wheel 700. In an implementation, the example multiphase grinding wheel 700 has a segmented contact surface in which abrasive segments 702 alternate with (e.g., nonwoven) fiber pad segments 704. In another implementation, each segment within a concentric ring may instead alternate with a neutral part of the wheel. The segments in a given segmented grinding wheel 700 may be either the abrasive surface or the nonwoven fiber pad surface. The example grinding wheel 700 may also include non-segmented concentric rings, such as concentric ring 706, used together on the same grinding face with the one or more segmented rings. The non-segmented concentric rings 706 may consist of either the abrasive or the nonwoven fiber pad.

Single and combination grinding wheels 300 may use variations in the width of the grinding face, and in the grit and bonding combinations. In an implementation, the fiber pad can be either a solid-woven or a nonwoven material. In an implementation, the fiber material is fixed to the backing plate, instead of being fixed to the conventional narrow race of a conventional grinding wheel 102 & 104. The backing plate itself may be one of numerous materials that can be flexible, non-flexible, solid, or slotted.

The abrasive for use on a concentric contact ring 302 can consist at least in part of CBN, diamond, or ceramic particles, for example, and can be bonded to a cloth material or to the backing plate by electroplating, coatings, resins, glues, fibers ceramics, vitrification, or other types of bonding. Thus, conventional or non-conventional grinding materials can be combined with cloth and the backing plate.

In an implementation, an example grinding wheel with a wider grinding face than conventional grinding wheels increases the surface area of contact with the cutting blade, the surface area of contact calculated to minimize deflection of the blade 100 off a narrow point.

In an implementation, a grinding wheel 300 with an increased coarseness of the grinding surface 302 allows longer run times, reducing glue buildup. The cut quality improves and persists for longer periods of time, and fire hazards are also reduced. A longer-running grinding wheel 300 also reduces human entry into the saw house or booth, improving safety and production.

In an implementation, the wider combined contact surfaces 302 & 304, as compared with conventional grinding wheels, allows coarser CBN or other abrasive to be bonded to the backing plate for more aggressive grinding and/or a longer grinding surface life. The backing plate can be metal, plastic, or a ferrous or non-ferrous material.

Example Tensioning System

For tensioning the multiphase grinding wheels 300 (or conventional grinding wheels) against the orbital cutting blade 100, an example air bladder system provides a dynamically correct sharpening tension between the grinding wheels 300 and the orbital blade 100 being sharpened.

Figure 8:
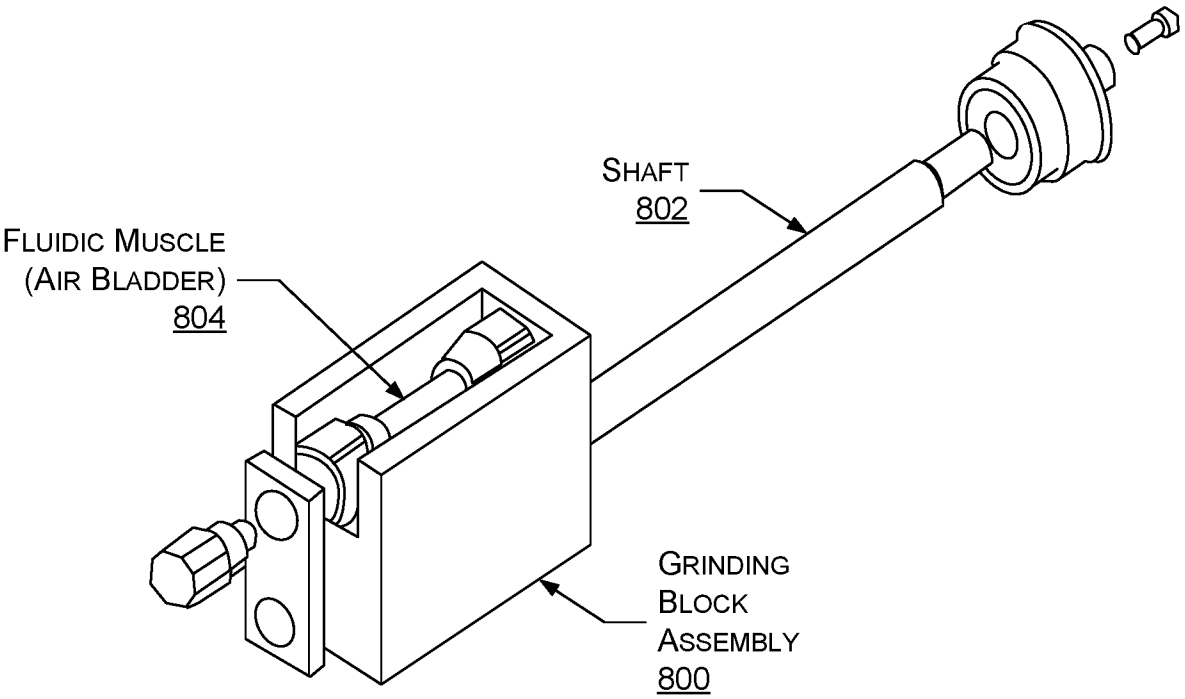
FIG. 8 is a diagram of an example grinding block assembly, including a fluidic muscle using an air bladder.

FIG. 8 shows an example grinding block assembly 800 that holds a grinding blade 300 (not shown in FIG. 8) on a shaft 802 against the orbital blade 100 (not shown in FIG. 8). Grinding block assemblies 800 of the air bladder tensioning system use a set of "fluidic muscles" 804 (with air bladders) that provide the pressure or tension between the grinding wheels 300 and the blade 100 during sharpening. The air bladders 804 afford some compressive spring, play, damping, elasticity, or flexibility in the pressure applied to hold the grinding wheels 300 against the blade 100 due to the elasticity and "give" of rubberized bladders 804 and also due to the ability of compressed air in the bladders 804 to provide a spring cushion. Conventionally, the pressure or tension between blade 100 and grinding wheel 102 is mechanically fixed and rigid, and has no "give," so that conventionally, any warp or variance in the flatness of the surfaces in contact with each other or any variance in the trueness of the axial spin of the blade 100 and grinding wheels 300 in their ideal planes results in unnecessary heat, friction, and aggressive wear of the surfaces.

With the example air bladder system using fluidic muscles 804, the sharpening tension can also be adjusted remotely, to remove human operators from the hazards of manual adjustments made around sharp and dangerous blade edges 100. In an implementation, the remote adjustment may even be automated. Further, when both improvements are used together, i.e., multiphase grinding wheels 300 used together with the fluidic muscle tensioners 804, superior blade sharpening is achieved and the longevity of both the orbital cutting blade 100 and the multiphase grinding wheels 300 is increased.

Figure 9:
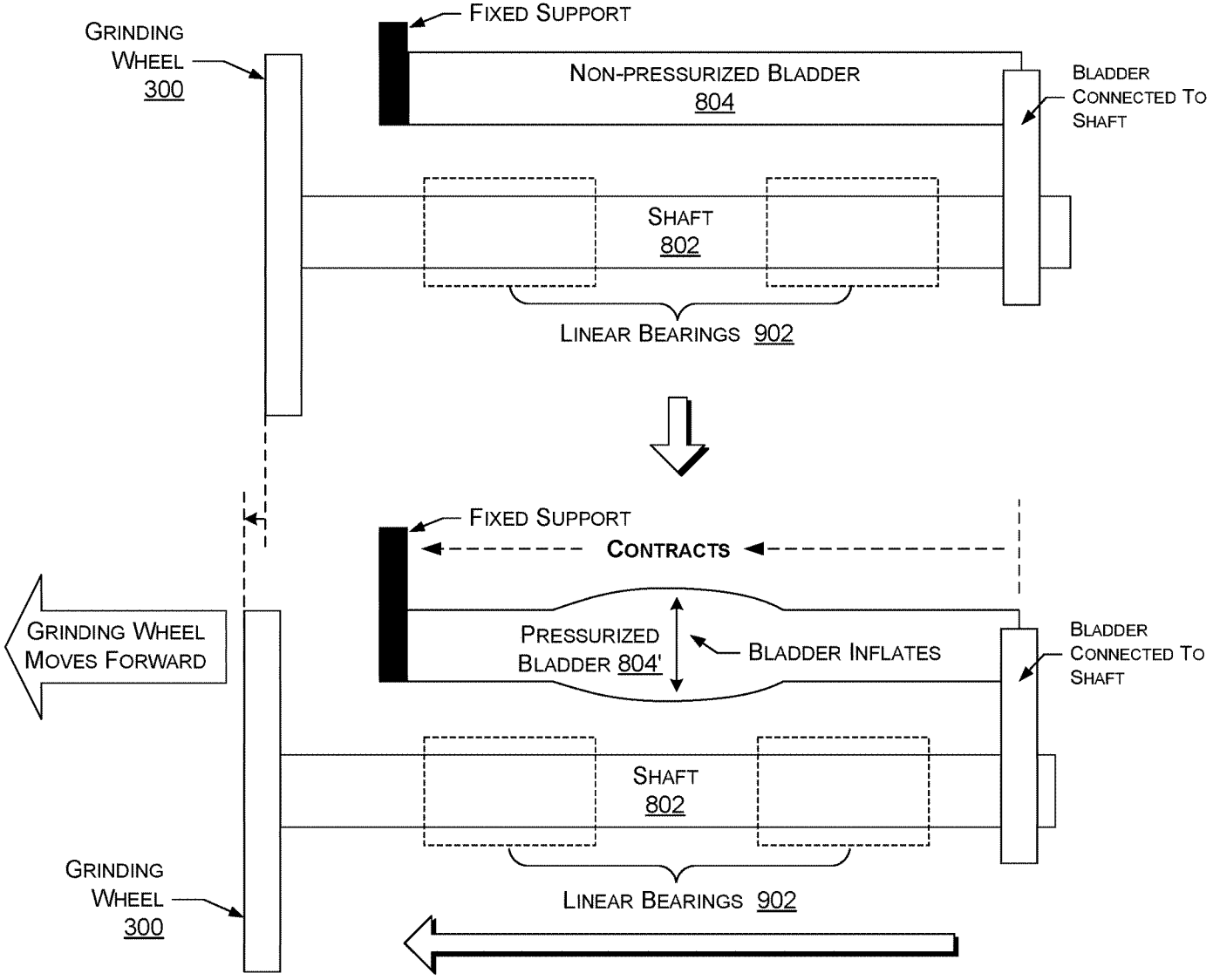
FIG. 9 is a diagram of example components and air bladder of the grinding block assembly.

FIG. 9 shows the grinding block assembly 800 of FIG. 8, in greater detail. The air bladder 804 of the fluidic muscle expands in a radial dimension when pneumatic pressure is applied, and the radial expansion causes the air bladder 804 to contract in the axial dimension. This contraction moves the shaft 802 within linear bearings 902 and is leveraged to push, or pull, the grinding face of a grinding wheel 300 on each side of the orbital cutting blade 100, into the edge being sharpened.

Figure 10:
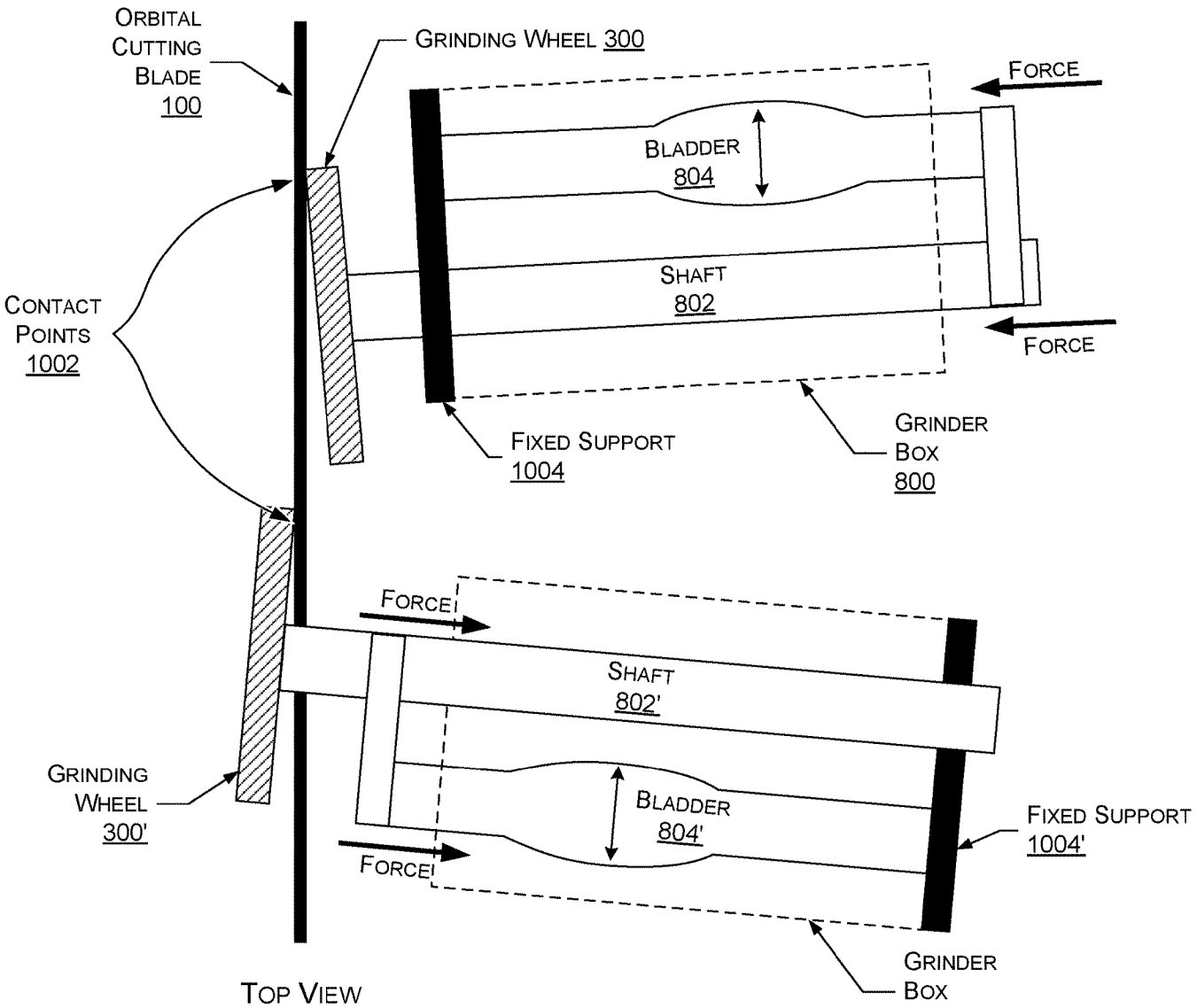
FIG. 10 is a diagram of example grinding block assemblies with grinding blades in contact on either side of an orbital cutting blade.

FIG. 10 shows two grinding block assemblies 800 and 800' rigged to hold tension on two grinding wheels 300 & 300' positioned on either side of the orbital cutting blade 100, with contact points 1002 on either side of the orbital blade 100. Depending on where the fixed support 1004 or 1004' is located in the configuration of the particular grinding block assembly 800 or 800', the pressurized air bladder 804 can either push (extend) the grinding wheel 300 into the blade 100 or pull (retract) the grinding wheel 300' into the far side of the blade 100.

The example system using air bladders 804 has some advantages. First, there are no rigidly mechanical parts to wear down as in a piston-style pneumatic cylinder. Second, the air bladder 804 and its air contents maintain some elasticity so that the grinding wheel 300 is not forced into the orbital blade 100 with an unyielding force that damages either the blade 100 or the grinding wheel 300 when maladjusted. Third, since the sharpening pressure being applied is more likely optimal, and self-adjusts in real-time because of the elasticity of the air bladder 804, all the interfacing parts last much longer.

In an implementation, the example system may include remote control that takes human operators out of the "saw house" or saw booth, the enclosure in which the sharp blades and potentially hazardous machinery reside. The remote control capability allows the operator to adjust the pneumatic sharpening tension from a safe distance. In an implementation, the adjustment of sharpening tension is handed over to computer control, or to a programmable logic controller (PLC).

In an implementation, the grinding wheels 300 & 300' are set a distance of 0.060 inch from the blade 100 before being brought into contact with the blade 100 by the fluidic muscles 804 for sharpening.

Figure 11:
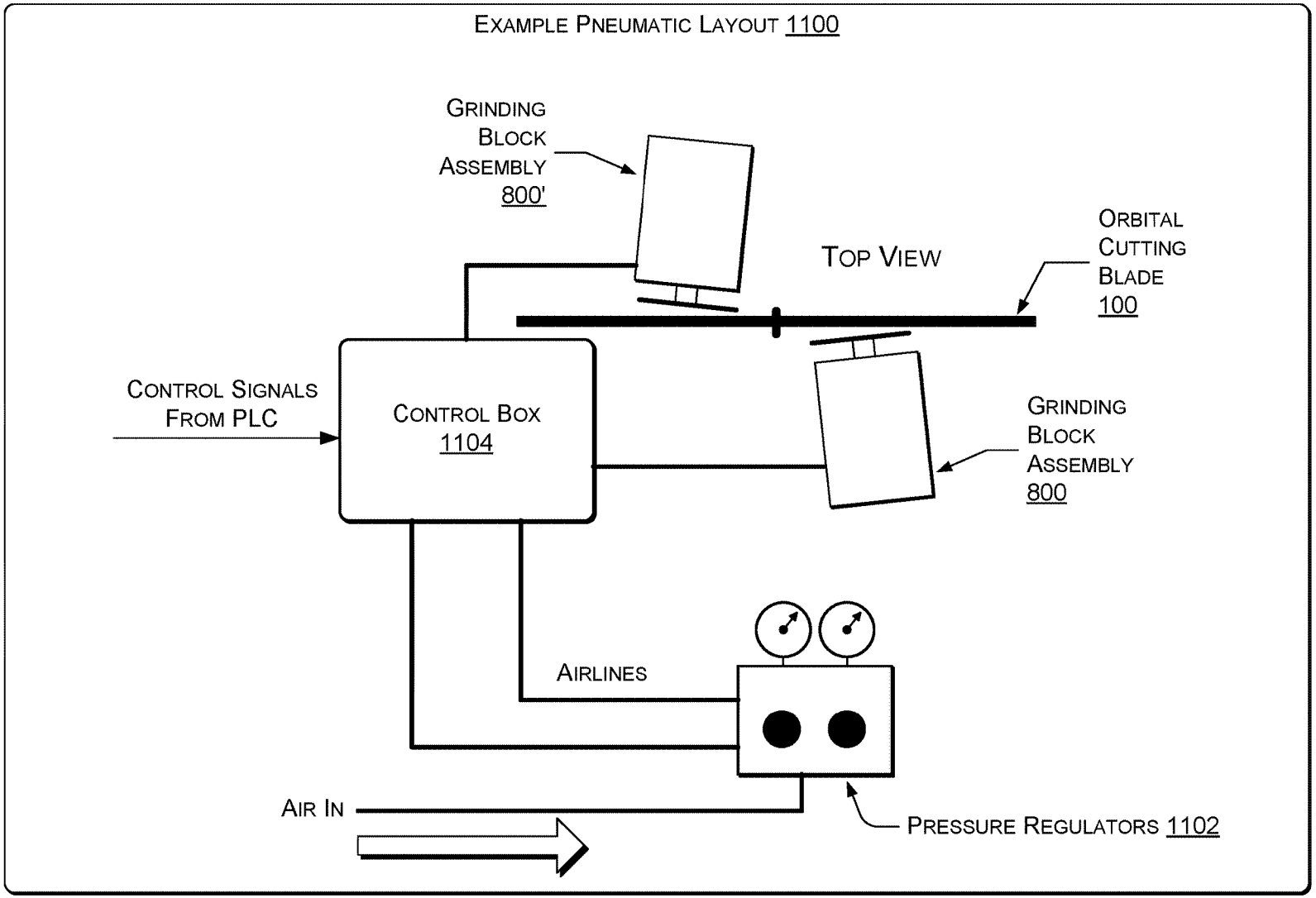
FIG. 11 is a diagram of an example pneumatic layout of the example blade sharpening system.

FIG. 11 shows an example pneumatic layout 1100 of the blade sharpening system. In FIG. 11, when ready to run, the sharpening tension applied to the grinding wheels 300 & 300' (the "stone pressure") is controlled by a set amount of air pressure from regulators, i.e., remote pressure regulators 1102 & 1102'. A control box 1104 receives the regulated air pressure and controls the air provided to the fluidic muscle air bladders 804 & 804' based on control signals from a computer, a PLC, or a human. The air bladders 804 pressurize and float, maintaining some air cushion or air spring as they are never in the fully extended position when providing pressure.

The air bladders 804 actuate the grinding wheels 300 into the orbital blade 100. The regulators 1102 & 1102' control the amount of maximum pressure between a grinding wheel 300 and the orbital blade 100.

In an implementation, an adjustable shaft 802 with lock can set the grinding wheel 300 to a specific distance from the blade 100. These features allow the grinding wheels 300 & 300' to make contact at the same time with the blade 100. Then, the grinding wheels 300 & 300' float with any lateral motion of the blade 100 as the air bladders 804 & 804' apply the sharpening tension.

Figure 12:
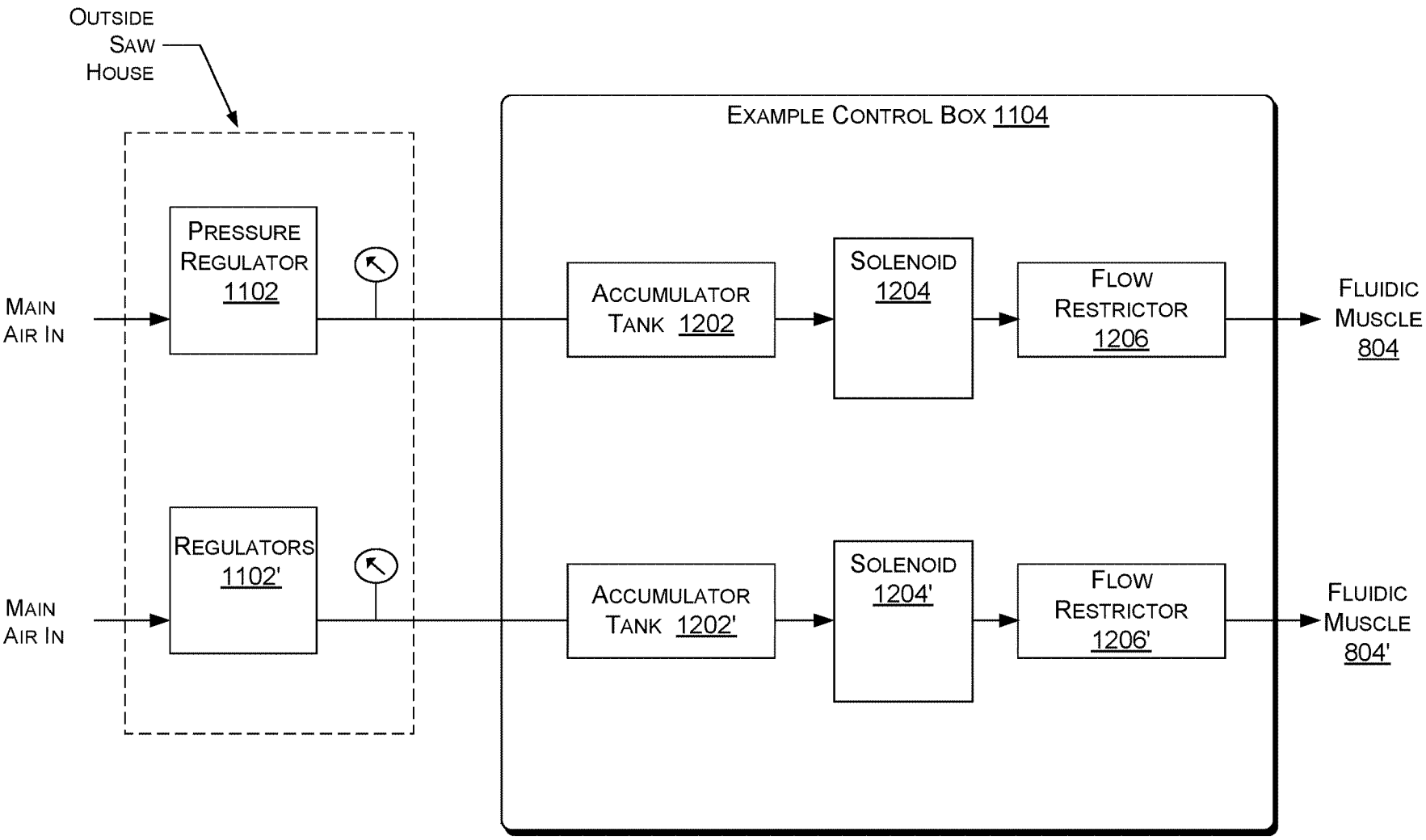
FIG. 12 is a block diagram of an example control box of the example blade sharpening system.

FIG. 12 shows the example control box 1104 of FIG. 11 in greater detail. The pressure regulators 1102 and 1102' may reside outside the saw house or booth. Each air line from a pressure regulator 1102 & 1102' is connected to an accumulator tank 1202 & 1202' in the control box 1104. The air supply continues to respective solenoids 1204 and 1204', which are under control of the PLC or computer (or human operator). Respective flow restrictors 1206 & 1206' are valves that apply a final flow control into the respective air bladders of the fluidic muscles 804 & 804'.

An operator or machine performs an example setup procedure consisting of 1) setting the "chord length" or the overlap of the grinding wheel to the blade; 2) setting each grinding wheel approximately 0.060 inch away from the blade; 3) starting the blade rotating and actuating the grinding system; 4) increasing the air pressure until one grinding wheel starts to spin lightly; 5) bringing in the second grinding wheel until it starts to spin; 6) and adding, for example, another two PSI of air pressure to the sharpening tension of each grinding wheel, e.g., using a pressure indicator. This example technique has the advantage that the blade is rotating when adjusting the grinding wheels. This eliminates frequent visits into the saw house to adjust the grinding wheel tension, and improves production up-time.

Example Method

Figure 13:
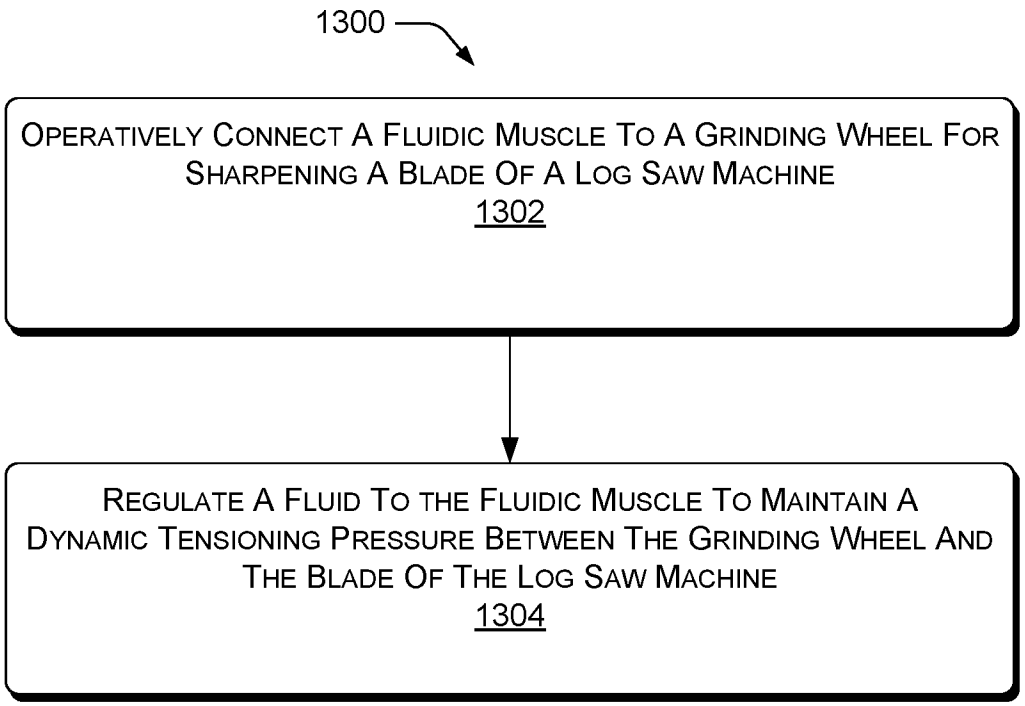
FIG. 13 is a flow diagram of an example method of improving blade sharpening of a log saw machine.

FIG. 13 shows an example basic method 1300 of improving blade sharpening of a log saw machine. The operations are shown in individual blocks.

At block 1302, a fluidic muscle is operatively connected to a grinding wheel for sharpening a blade of a log saw machine.

At block 1304, a fluid to the fluidic muscle is regulated to maintain an effective sharpening pressure between the grinding wheel and the blade of the log saw machine.

Example Control Environment

Figure 14:
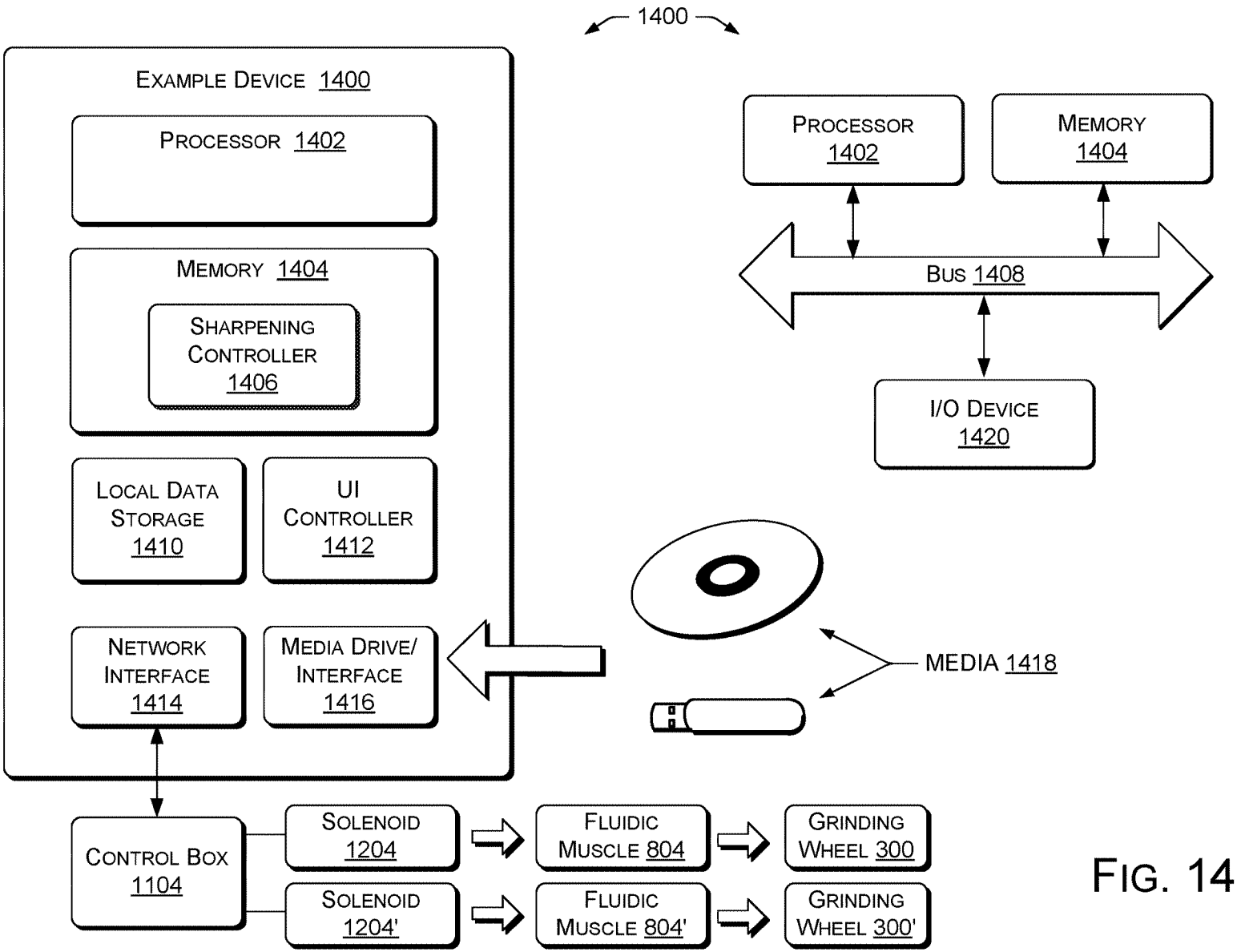
FIG. 14 is a block diagram of an example computing device or programmable logic controller (PLC) environment for blade sharpening control.

The example blade sharpening system uses a programmable logic controller (PLC) or other computing device for electronic control of pneumatic and mechanical components. FIG. 14 shows an example computing device 1400 to at least assist in controlling the example sharpening system. Example device 1400 has a processor 1402, and memory 1404 for hosting an example sharpening controller 1406. The shown example device 1400 is only one example of a computing device or programmable device, and is not intended to suggest any limitation as to scope of use or functionality of the example device 1400 and/or its possible architectures. Neither should the example device 1400 be interpreted as having any dependency or requirement relating to one or to a combination of components illustrated in the example device 1400.

Example device 1400 includes one or more processors or processing units 1402, one or more memory components 1404, the sharpening controller 1406, a bus 1408 that allows the various components and devices to communicate with each other, and includes local data storage 1410, among other components.

Memory 1404 generally represents one or more volatile data storage media. Memory component 1404 can include volatile media (such as random access memory (RAM)) and/or nonvolatile media (such as read only memory (ROM), flash memory, and so forth).

Bus 1408 represents one or more of any of several types of bus structures, including a memory bus or memory controller, a peripheral bus, an accelerated graphics port, and a processor or local bus using any of a variety of bus architectures. Bus 1408 can include wired and/or wireless buses.

Local data storage 1410 can include fixed media (e.g., RAM, ROM, a fixed hard drive, etc.) as well as removable media (e.g., a flash memory drive, a removable hard drive, optical disks, magnetic disks, and so forth).

A user interface device may also communicate via a user interface (UI) controller 1412, which may connect with the UI device either directly or through the bus 1408.

A network interface 1414 may communicate outside of the example device 1400 via a connected network, and in some implementations may communicate with hardware.

A media drive/interface 1416 accepts removable tangible media 1418, such as flash drives, optical disks, removable hard drives, software products, etc. Logic, computing instructions, or a software program comprising elements of the sharpening controller 1406 may reside on removable media 1418 readable by the media drive/interface 1416.

One or more input/output devices 1420 can allow a user to enter commands and information to example device 1400, and also allow information to be presented to the user and/or other components or devices. Examples of input devices 1420 include keyboard, a cursor control device (e.g., a mouse), a microphone, a scanner, and so forth. Examples of output devices include a display device (e.g., a monitor or projector), speakers, a printer, a network card, and so forth.

Various processes of the sharpening controller 1406 may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer readable media. Computer readable media can be any available data storage medium or media that is tangible and can be accessed by a computing device. Computer readable media may thus comprise computer storage media.

"Computer storage media" designates tangible media, and includes volatile and non-volatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

CONCLUSION

Although only a few example embodiments have been described in detail above, those skilled in the art will readily appreciate that many modifications are possible in the example embodiments without materially departing from the subject matter. Accordingly, all such modifications are intended to be included within the scope of this disclosure as defined in the following claims.

The invention claimed is:

1. A system, comprising:

a log cutting blade for cutting a paper log;

at least a grinding wheel in contact with a cutting edge of the log cutting blade;

a pneumatic tensioner comprising a rubberized air bladder to maintain an elastic and dynamically flexible pressure between the grinding wheel and the cutting edge of the log cutting blade; and wherein both the rubberized air bladder and the compressibility of air inside the rubberized air bladder of the pneumatic tensioner provide a self-adjusting air spring and elastic rubber damping to create the dynamically flexible pressure between the grinding wheel and the cutting edge of the log cutting blade.

2. The system of claim 1, wherein the rubberized air bladder comprises a fluidic muscle that expands in a radial dimension when pneumatic pressure is applied, and the radial expansion causes the air bladder to contract in an axial dimension.

3. The system of claim 2, further comprising a remote control station to actuate and adjust the pneumatic tensioner remotely at a safe distance from the log cutting blade, wherein the control station comprises a programmable logic controller (PLC) to remotely control the air provided to the fluidic muscle.

4. The system of claim 2, wherein the remote PLC controls the pneumatic tensioner to maintain a correct sharpening tension between the grinding wheel and the cutting edge during fluctuations of distance and pressure between the grinding wheel and the cutting edge, the PLC programmed to pressurize the rubberized air bladder to a float level maintaining an air cushion or the air spring.

5. The system of claim 2, further comprising first and second grinding wheels on each side of the log cutting blade, configured to simultaneously sharpen each side of the log cutting blade, wherein the PLC controls respective pressure regulators for first and second fluidic muscles on each side of the log cutting blade, the first and second fluidic muscles maintaining independent amounts of pressure on the respective first and second grinding wheels.

6. The system of claim 2, further comprising a band of fiber abrasive pad on the grinding wheel, wherein a compressibility of the band of fiber abrasive pad and the air cushion of the rubberized air bladder additively combine to create the total dynamically flexible pressure between the grinding wheel and the cutting edge.

7. The system of claim 6, wherein the band of fiber abrasive pad on the grinding wheel and the air spring provided by the pneumatic tensioner maintain a pressure in real time between the grinding wheel and the log cutting blade calculated to increase a lifespan of the grinding wheel and a lifespan of the log cutting blade.

8. A system, comprising:

a log cutting blade for cutting a paper log;

at least a grinding wheel in contact with a cutting edge of the log cutting blade;

a pneumatic tensioner comprising a rubberized air bladder to maintain an elastic and dynamically flexible pressure between the grinding wheel and the cutting edge of the log cutting blade; and wherein the rubberized air bladder comprises a fluidic muscle that expands in a radial dimension when pneumatic pressure is applied, and the radial expansion causes the air bladder to contract in an axial dimension.

9. The system of claim 8, wherein both the rubberized air bladder and the compressibility of air inside the rubberized air bladder of the pneumatic tensioner provide a self-adjusting air spring and elastic rubber damping to create the dynamically flexible pressure between the grinding wheel and the cutting edge of the log cutting blade.

10. The system of claim 9, further comprising a remote control station to actuate and adjust the pneumatic tensioner remotely at a safe distance from the log cutting blade, wherein the control station comprises a programmable logic controller (PLC) to remotely control the air provided to the fluidic muscle.

11. The system of claim 9, wherein the remote PLC controls the pneumatic tensioner to maintain a correct sharpening tension between the grinding wheel and the cutting edge during fluctuations of distance and pressure between the grinding wheel and the cutting edge, the PLC programmed to pressurize the rubberized air bladder to a float level maintaining an air cushion or the air spring.

12. The system of claim 9, further comprising first and second grinding wheels on each side of the log cutting blade, configured to simultaneously sharpen each side of the log cutting blade, wherein the PLC controls respective pressure regulators for first and second fluidic muscles on each side of the log cutting blade, the first and second fluidic muscles maintaining independent amounts of pressure on the respective first and second grinding wheels.

13. The system of claim 9, further comprising a band of fiber abrasive pad on the grinding wheel, wherein a compressibility of the band of fiber abrasive pad and the air cushion of the rubberized air bladder additively combine to create the total dynamically flexible pressure between the grinding wheel and the cutting edge.

14. The system of claim 13, wherein the band of fiber abrasive pad on the grinding wheel and the air spring provided by the pneumatic tensioner maintain a pressure in real time between the grinding wheel and the log cutting blade calculated to increase a lifespan of the grinding wheel and a lifespan of the log cutting blade.

* * * * *